US011421931B2

(12) United States Patent
Iglesias Ballester

(10) Patent No.: US 11,421,931 B2
(45) Date of Patent: Aug. 23, 2022

(54) ENCLOSURE FOR REFRIGERATING CHAMBERS

(71) Applicant: AMISERRU, S.L., Sant Cugat del Valles (ES)

(72) Inventor: Miguel Angel Iglesias Ballester, Sant Cugat del Valles (ES)

(73) Assignee: AMISERRU, S.L., Sant Cugat del Valles (ES)

( * ) Notice: Subject to any disclaimer, the term of this patent is extended or adjusted under 35 U.S.C. 154(b) by 726 days.

(21) Appl. No.: 16/387,787

(22) Filed: Apr. 18, 2019

(65) Prior Publication Data

US 2019/0338998 A1 Nov. 7, 2019

(30) Foreign Application Priority Data

May 4, 2018 (ES) ..... ES201830440

(51) Int. Cl.

| | |
|---|---|
| ***F25D 21/12*** | (2006.01) |
| ***E06B 9/13*** | (2006.01) |
| ***F25D 23/02*** | (2006.01) |
| ***F25D 21/04*** | (2006.01) |
| ***E06B 9/11*** | (2006.01) |

(Continued)

(52) U.S. Cl.

CPC ..... *F25D 21/125* (2013.01); *E06B 9/11* (2013.01); *E06B 9/13* (2013.01); *E06B 9/58* (2013.01); *F25D 21/04* (2013.01); *F25D 23/021* (2013.01); *F25D 23/025* (2013.01); *F25D 23/028* (2013.01); *E06B 2009/586* (2013.01); *F25D 13/00* (2013.01)

(58) Field of Classification Search

CPC .... F25D 23/021; F25D 23/023; F25D 23/025; F25D 23/028; F25D 13/00; F25D 2321/00; F25D 2323/02; E06B 2009/586; E06B 9/58

See application file for complete search history.

(56) References Cited

U.S. PATENT DOCUMENTS 3,190,207 A * 6/1965 Weisz ..... F24F 9/00 454/192
4,156,482 A * 5/1979 Tomlinson ..... B65G 57/28 414/798.2

(Continued)

FOREIGN PATENT DOCUMENTS

DE 19625215 A1 * 1/1998 ..... E06B 9/08
DE 202011001804 U1 * 4/2012 ..... E06B 9/11

*Primary Examiner* — Andrew M Roersma
(74) *Attorney, Agent, or Firm* — Hodgson Russ LLP

(57) ABSTRACT

The invention relates to an enclosure for refrigerating chambers, suitable for closing an access (3) to a refrigerating chamber and comprising: —a sliding refrigerating door (1), and —a quick-opening door (2), both assembled on the same side of the chamber, comprising a frame with vertical posts (4), comprising: —on an outer face, at least one mouth (42) wherein a fan (6) is coupled which introduces air in the corresponding vertical post (4); —on the inside thereof, a deflector plate (61) which directs the air towards electrical resistors (7) for heating the air, situated underneath the deflector plate and, —on an inner face, an outlet (43) for supplying hot air on one of the surfaces, inner or outer, of the flexible sheet (21) exposed to the cold of the chamber and removing frost from said flexible sheet (21).

13 Claims, 4 Drawing Sheets

(51) Int. Cl.
*E06B 9/58* (2006.01)
*F25D 13/00* (2006.01)

(56) References Cited

U.S. PATENT DOCUMENTS 5,203,175 A * 4/1993 Farrey ..... F25D 21/04
62/282
5,544,690 A * 8/1996 Magro ..... E06B 9/68
160/133
6,226,995 B1 * 5/2001 Kalempa ..... F25D 21/04
454/192
6,470,949 B1 * 10/2002 Iglesias Ballester .....
F25D 23/025
49/63
6,960,129 B2 * 11/2005 Ashley ..... F25D 23/023
454/192
8,376,822 B1 * 2/2013 Smith ..... A61N 7/02
454/188
2016/0102489 A1 * 4/2016 Iglesias Ballester .....
E06B 3/4645
160/63

* cited by examiner

ENCLOSURE FOR REFRIGERATING CHAMBERS

CROSS REFERENCE TO RELATED APPLICATIONS

This application claims priority to Spanish Patent Application No. P201830440, filed on May 4, 2018, the entire disclosure of which is hereby incorporated by reference.

OBJECT OF THE INVENTION

The object of the present invention is an enclosure for refrigerating chambers, suitable for closing an access opening to a refrigerating chamber and comprising: a sliding refrigerating door, and a quick-opening door which has a frame provided with vertical posts, at least one flexible sheet exposed to the cold of the refrigerating chamber movable along guides of the vertical posts; and a motorised drum, provided with a protective cover, for rolling and unrolling said flexible sheet.

This enclosure for refrigerating chambers has constructive particularities intended to prevent frost from forming on the flexible sheet of the rolling door exposed to the cold of the refrigerating chamber; and eventually, additionally, to prevent ice or frost from forming in the rolling area of the flexible sheet situated inside the protective cover.

FIELD OF APPLICATION OF THE INVENTION

This invention is applicable in the sector of refrigerating chambers.

STATE OF THE ART

Document ES 2 166 246 B1 of the same applicant describes a closing system for refrigerating chambers comprising a sliding refrigerating door and parallel to it, in the direction towards the inside of the chamber, a quick-opening door intended to minimise the temperature losses while the outer refrigerating door stays open.

In said prior art, both the refrigerating or insulating door and the quick-opening door are situated on the outer portion of the access opening to the refrigerating chamber such that the flexible sheet of the quick-opening door stays exposed to the cold from the inside of the refrigerating chamber but the motorised drum responsible for rolling and unrolling said flexible sheet is arranged on the outer portion of the access opening to the chamber.

An additional drawback of this type of door is the formation of frost on the flexible sheet of the quick-opening door which stays exposed to the cold from the inside of the refrigerating chamber since this frost considerably and irregularly increases the thickness of the flexible sheet, and when it is rolled onto the motorised drum, during the opening operations of the door it forms a roll that is too thick which can butt against the protective cover of the motorised drum.

In the case of the quick-opening door having two parallel flexible sheets, which create an insulating chamber between them, the thickness of the frost is only produced on one of the flexible sheets, specifically the flexible sheet exposed to the cold of the refrigerating chamber; causing the movement of the two flexible sheets to not be performed in a coordinated manner, which can cause operating errors of the quick-opening door.

Although it is true that there is some prior art of quick-opening doors with flexible sheets and which incorporate means for projecting air into the space comprised between both flexible sheets, the proposed solutions are not especially effective in the case of enclosures for refrigerating chambers, like the one described previously, since the projected air does not reach the entire surface of the flexible sheets in a uniform manner, mainly due to the fact that air at a higher temperature moves towards the upper area of the opening and does not prevent frost from forming in the lower portion of the flexible sheet in contact with the low temperatures existing inside the refrigerating chamber.

The applicant does not know of the existence of prior art which satisfactorily solves the explained problem and which has characteristics analogous to those of the present invention.

DESCRIPTION OF THE INVENTION

The enclosure for refrigerating chambers object of this invention is suitable for closing an access opening to a refrigerating chamber and, comprising a sliding refrigerating door; and a quick-opening door comprising: a frame provided with vertical posts, at least one flexible sheet, exposed to the cold of the chamber, movable along guides of the vertical posts; and a motorised drum, provided with a protective cover, for rolling and unrolling said flexible sheet, as envisaged in the preamble of the main claim; it has characteristics intended to satisfactorily solve the previously explained problem and, specifically, preventing frost from forming on the flexible sheet of the quick-opening door exposed to the cold of the chamber.

To do so and according to the invention, the vertical posts of the frame of the quick-opening door comprise: —on an outer face, at least one mouth wherein a fan is coupled in order to introduce air to the corresponding vertical post; —on the inside thereof, a deflector plate which directs the air supplied by the fan to the lower area of the vertical post, and underneath said deflector plate electrical resistors for heating the supplied air and, —on an inner face, an outlet for supplying hot air on one of the surfaces, inner or outer, of the flexible sheet exposed to the cold of the chamber and the removal of frost from said flexible sheet.

The arrangement on the inside of the very vertical posts of the quick-opening door of the mentioned reflecting plate and, underneath it, the electrical resistors responsible for heating the supplied air which, besides simplifying the assembly thereof, ensure that the hot air is directed towards the lower area of the quick-opening door rising along the inner or outer surface of the flexible sheet of the quick-opening door exposed to the cold, ensuring that frost is not formed on any point of the surface thereof.

In order to ensure this objective, depending on the height of the door, it has been foreseen that each of the vertical posts of the frame of the quick-opening door incorporates several groups of fans, reflectors, resistors and hot air outlets arranged at different heights, ensuring that the hot air reaches the upper area, the intermediate area and the lower area of the flexible sheet.

In one embodiment of the invention, the quick-opening door incorporates, on the inside of the protective cover of the motorised drum, electrical resistors which prevent ice or frost from forming in said area.

It is worth mentioning that the hot air outlets can be arranged on one side or another of the flexible sheet of the quick-opening door exposed to the cold of the refrigerating chamber and that said quick-opening door can have a single flexible sheet, or two flexible sheets arranged parallel to each other and which are rolled or unrolled simultaneously in the motorised drum.

In an alternative embodiment of the invention, the means for preventing frost from forming on the flexible sheet of the quick-opening door oriented towards the inside of the chamber are arranged on the top and not in the vertical posts of the frame.

The characteristics of the invention shall be more readily understandable in light of the exemplary embodiment shown in the attached figures described below

DESCRIPTION OF THE FIGURES

As a complement to the description provided herein, and for the purpose of helping to make the characteristics of the invention more readily understandable, the present specification is accompanied by a set of drawings which, by way of illustration and not limitation, represent the following.

PREFERRED EMBODIMENT OF THE INVENTION

Figure 1:
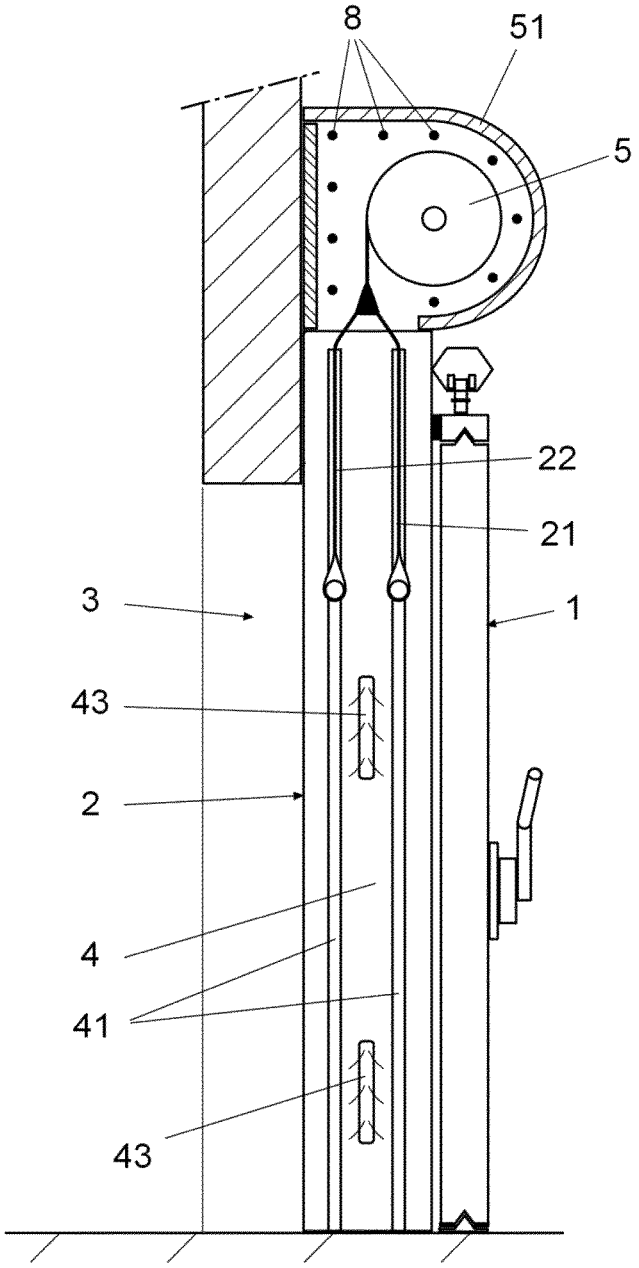
FIG. 1 shows a schematic profile view of an exemplary embodiment of the enclosure for refrigerating chambers according to the invention wherein the refrigerating door and the quick-opening door, in this case with a double flexible sheet, are assembled on the outer side of the access opening to the chamber; there being a cross section of the quick-opening door and a portion of the chamber along a vertical plane.

In an exemplary embodiment shown in FIG. 1, the enclosure comprises a sliding refrigerating door (1) assembled against a quick-opening door (2) which is in turn installed on the outer side of an access opening (3) to a refrigerating chamber.

The quick-opening door (2) comprises a frame provided with vertical posts (4) which have vertical guides (41) for the movement of flexible sheets (21, 22) which are rolled or unrolled simultaneously in a motorised drum (5) provided with a protective cover (51).

Figure 2:
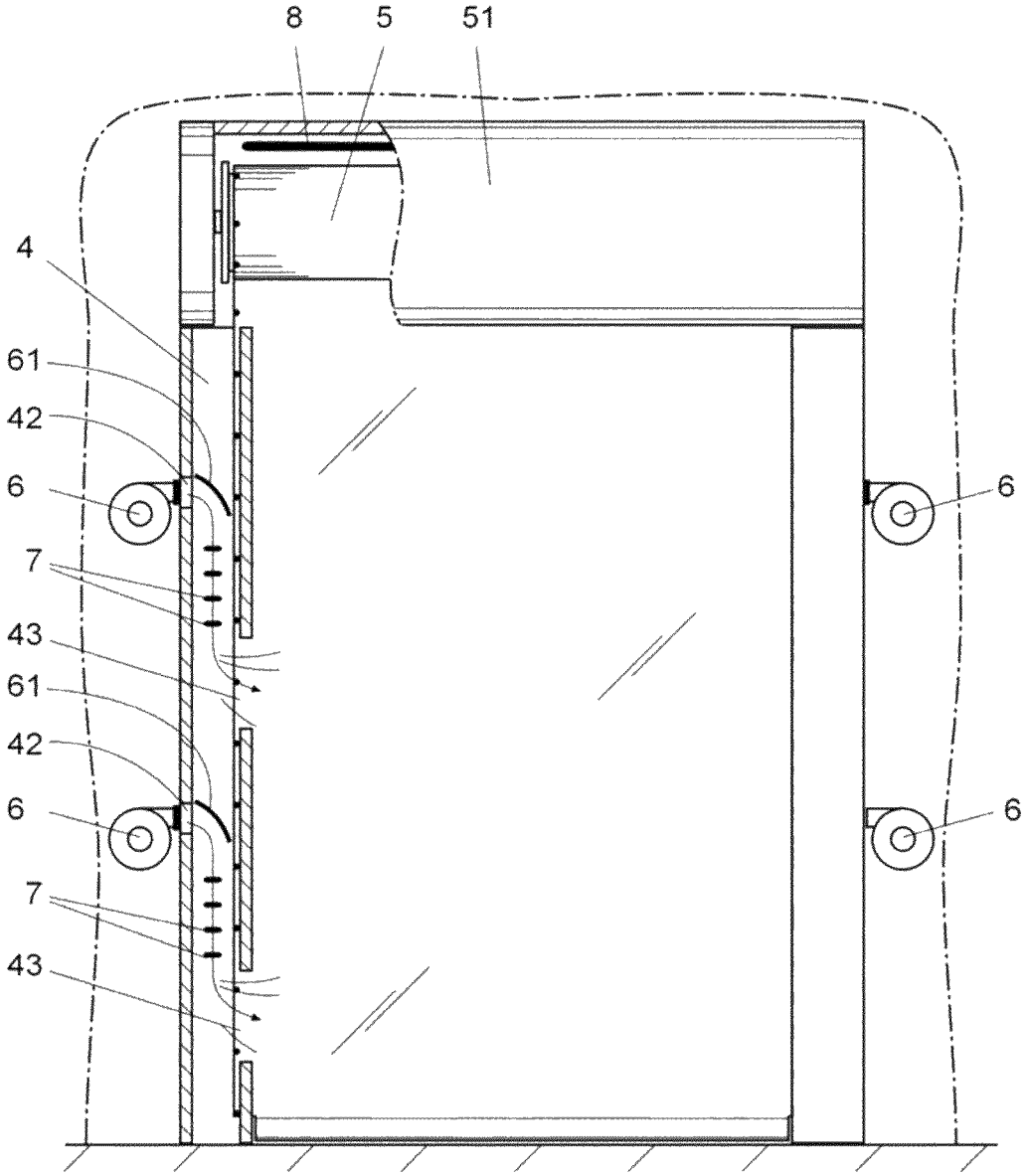
FIG. 2 shows an elevation view of the enclosure of FIG. 1 seen from the inside of the refrigerating chamber and in a partial cross section in order to enable the visualisation of the means for supplying hot air to the flexible sheet of the quick-opening door oriented towards the inside of the refrigerating chamber.

As seen in FIG. 2, the vertical posts (4) have on the outer face thereof mouths (42) wherein fans (6) are assembled which blow air towards the inside of said vertical posts (4).

Inside the vertical posts (4) there are deflector plates (61) which direct the air towards the lower air causing the circulation thereof on electrical resistors (7) which perform the heating thereof.

Said vertical posts (4) have on the inner face, which delimits the access opening (3), outlets (43) arranged at different heights, for supplying hot air, in this case, towards the space comprised between the two flexible sheets (21, 22) of the quick-opening door (2), preventing frost from forming on the flexible sheet (22) exposed to the cold of the chamber.

Figure 3:
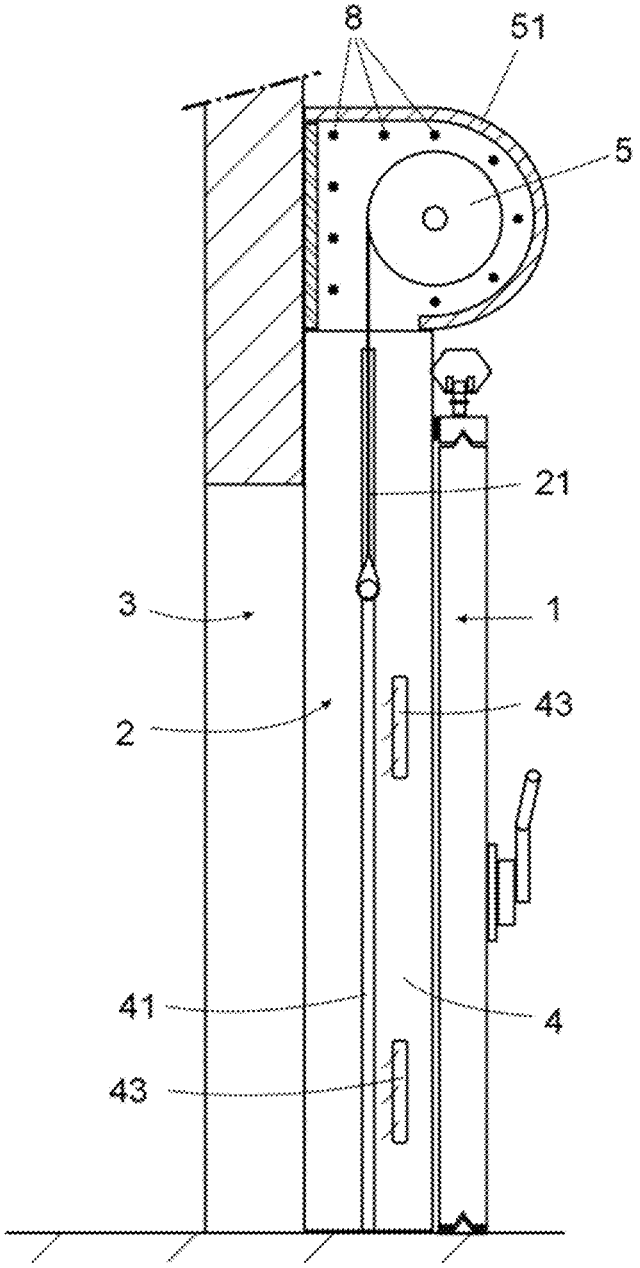
FIG. 3 shows a view similar to FIG. 1 of a variant embodiment wherein the quick-opening door has a single flexible sheet and the hot air outlets project the air on the outer surface of the flexible sheet, meaning, on the surface oriented towards the outside of the chamber.

In the variant embodiment shown in FIG. 3, the quick-opening door has a single closing flexible sheet (21), the outlets (43) being conveniently arranged to supply the hot air on the outer surface thereof of the flexible sheet (21) oriented towards the outside of the refrigerating chamber.

Figure 4:
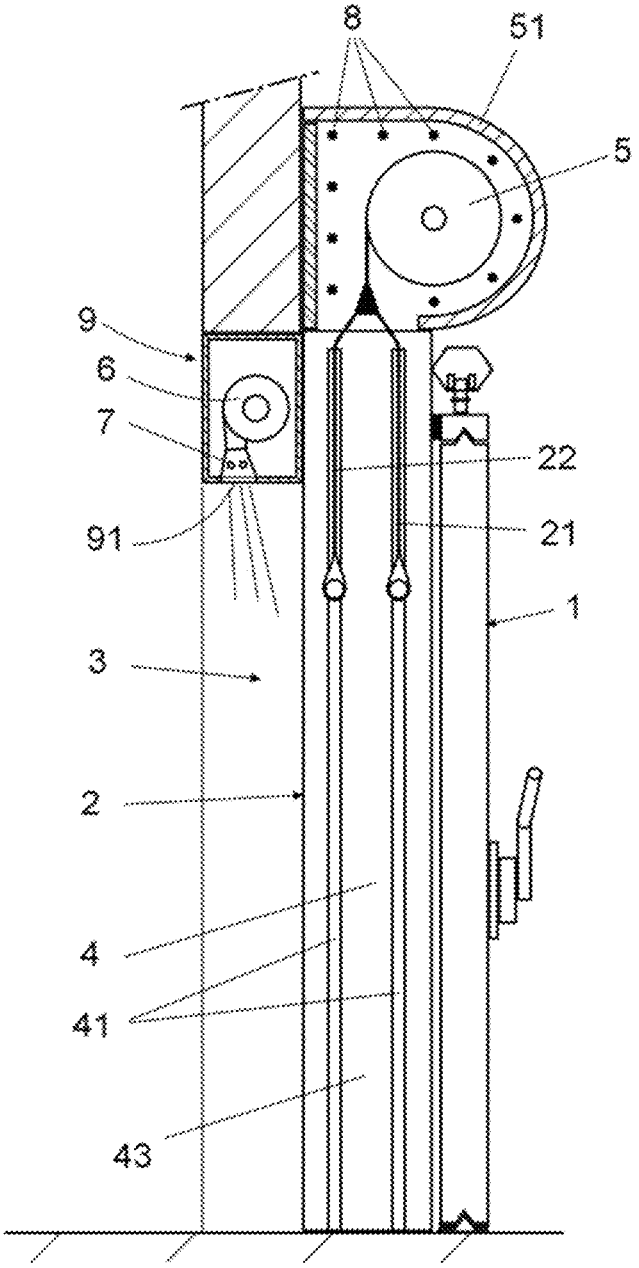
FIG. 4 shows an alternative embodiment of the invention, wherein the fans and the resistors for heating the air are housed in a device situated in the upper portion of the access opening, and not in the vertical posts of the frame, projecting the hot air from the upper portion towards the lower area.

In the variant embodiment shown in FIG. 4, the quick-opening door comprises in the upper portion thereof, on the side oriented towards the inside of the refrigerating chamber, a heating device (9) which has on the inside thereof: fans (6) which blow air at a variable speed towards a lower area and electrical resistors (7) which heat the air projected by the fans (6); said heating device (9) having in a lower area slits (91) which project the hot air towards the flexible sheet (22) of the quick-opening door exposed to the cold of the chamber, preventing frost from forming thereon.

In the embodiments shown, the motorised drum (5) is assembled on the side of the access opening corresponding to the inside of the refrigerating chamber, facilitating the assembly of the enclosure. In these embodiments, the enclosure comprises on the inside of the space delimited by the protective cover (51) electrical resistors (8) which prevent ice or frost from forming in said area.

Having sufficiently described the nature of the invention, in addition to a preferred exemplary embodiment, it is hereby stated for the relevant purposes that the materials, shape, size and layout of the described elements may be modified, provided that it does not imply altering the essential characteristics of the invention claimed below.

The invention claimed is:

1. A closure assembly for closing an access opening (3) to a refrigerating chamber, the closure assembly comprising:
- a sliding refrigerating door (1); and
- a quick-opening door (2);
- wherein both said doors (1, 2) are assembled on one same side of the access opening (3) to the refrigerating chamber, and;
- the quick-opening door (2) comprising:
  - a frame provided with vertical posts (4);
  - at least one flexible sheet (21, 22), exposed to the refrigerating chamber, the at least one flexible sheet (21, 22) movable along guides (41) of the vertical posts (4); and
  - a motorised drum (5), provided with a protective cover (51), the motorised drum (5) rolling and unrolling said at least one flexible sheet (21, 22);
  - wherein each of the vertical posts (4) of the frame of the quick-opening door (2) comprises:
    - on an outer face thereof, at least one mouth (42) wherein a fan (6) is coupled at the at least one mouth (42) and introduces air into the vertical post (4);
    - on an inside thereof, a deflector plate (61) which directs the air introduced by the fan (6) to a lower area of the vertical post (4), and electrical resistors (7) for heating the air are positioned underneath said deflector plate (61); and
    - on an inner face thereof, an outlet (43) for supplying the heated air to an inner or outer surface of the at least one flexible sheet (21, 22), the inner or outer surface being exposed to the refrigerating chamber, and the heated air removing frost from said at least one flexible sheet (21, 22).

2. The closure assembly according to claim 1, wherein each of the vertical posts (4) of the frame of the quick-opening door (2) comprises several groups of said fans (6), said deflector plates (61), said electrical resistors (7) and said outlets (43); wherein said several groups are arranged at different heights.

3. The closure assembly according to claim 1, wherein the quick-opening door (2) and the motorised drum (5) are attached on the one same side of the access opening (3); and an inside of the protective casing (51) of the motorised drum (5) includes electrical resistors (8) which prevent frost from forming in said protective casing (51).

4. The closure assembly according to claim 1, wherein the quick-opening door (2) comprises two said flexible sheets (21, 22), parallel, with simultaneous rolling; the outlets (43) of the vertical posts (4) being defined between the guides (41).

5. The closure assembly according to claim 1, wherein the quick-opening door (2) comprises a single said flexible sheet (21), the outlets (43) being conveniently arranged to supply the heated air on the outer surface of the single flexible sheet (21).

6. A closure assembly for closing an access opening (3) to a refrigerating chamber, the closure assembly comprising:

a sliding refrigerating door (1); and a quick-opening door (2);

wherein both said doors (1, 2) are assembled on one same side of the access opening (3) to the refrigerating chamber, and;

the quick-opening door (2) comprising;

a frame provided with vertical posts (4);

at least one flexible sheet (21, 22), having a side exposed to the refrigerating chamber, the at least one flexible sheet (21, 22) movable along guides (41) of the vertical posts (4);

a motorised drum (5), provided with a protective cover (51), the motorised drum (5) rolling and unrolling said at least one flexible sheet (21, 22); and a heating device (9) at an upper portion of the quick-opening door (2), and oriented towards the refrigerating chamber, the heating device (9) comprising:

fans (6) on an inside of the heating device (9) and which blow air at a variable speed towards a lower area;

electrical resistors (7) which heat the air blown at variable speed by the fans (6); and slits (91) in a lower area of the heating device (9) and which project the air heated by the electrical resistors (7) towards the side of the at least one flexible sheet (21, 22) that is exposed to the refrigerating chamber, preventing frost from forming thereon.

7. The closure assembly according to claim 2, wherein the quick-opening door (2) and the motorised drum (5) are attached on the one same side of the access opening (3); and an inside of the protective casing (51) of the motorised drum (5) includes electrical resistors (8) which prevent frost from forming in said protective casing (51).

8. The closure assembly according to claim 7, wherein the quick-opening door (2) comprises two said flexible sheets (21, 22), parallel, with simultaneous rolling; the outlets (43) of the vertical posts (4) being defined between the guides (41).

9. The closure assembly according to claim 7, wherein the quick-opening door (2) comprises a single said flexible sheet (21), the outlets (43) being conveniently arranged to supply the heated air on the outer surface of the single flexible sheet (21).

10. The closure assembly according to claim 2, wherein the quick-opening door (2) comprises two said flexible sheets (21, 22), parallel, with simultaneous rolling; the outlets (43) of the vertical posts (4) being defined between the guides (41).

11. The closure assembly according to claim 2, wherein the quick-opening door (2) comprises a single said flexible sheet (21), the outlets (43) being conveniently arranged to supply the heated air on the outer surface of the single flexible sheet (21).

12. The closure assembly according to claim 3, wherein the quick-opening door (2) comprises two said flexible sheets (21, 22), parallel, with simultaneous rolling; the outlets (43) of the vertical posts (4) being defined between the guides (41).

13. The closure assembly according to claim 3, wherein the quick-opening door (2) comprises a single said flexible sheet (21), the outlets (43) being conveniently arranged to supply the heated air on the outer surface of the single flexible sheet (21).

* * * * *